United States Patent [19]

Franklin et al.

[11] 4,422,501

[45] Dec. 27, 1983

[54] EXTERNAL ARTERY HEAT PIPE

[75] Inventors: James L. Franklin, Kent; Roger L. Shannon, Federal Way; Dale F. Watkins, Sumner, all of Wash.

[73] Assignee: The Boeing Company, Seattle, Wash.

[21] Appl. No.: 341,949

[22] Filed: Jan. 22, 1982

[51] Int. Cl.[3] ..... F28D 15/00

[52] U.S. Cl. ..... 165/104.26; 165/104.23

[58] Field of Search ..... 165/104.26

[56] References Cited

U.S. PATENT DOCUMENTS 3,803,688 4/1974 Peck ..... 165/104.26 X 3,844,342 10/1974 Eninger et al. ..... 165/104.26

3,913,665 10/1975 Franklin et al. ..... 165/104.26

*Primary Examiner*—Albert W. Davis, Jr.

*Attorney, Agent, or Firm*—William C. Anderson

[57] ABSTRACT

An improved heat pipe (115) of increased heat transport capacity comprising a vapor tube (120) and a liquid-condensate return tube (130). An outwardly extending conduit (125), disposed in both the evaporator section (135) and evaporator section (140) of the heat pipe (115), provides fluid communication between the vapor tube (120) and the return tube (130). Circumferential v-shaped grooves (145) terminate at a slot-like opening (165) formed in each of the conduits (125). A cap member (170) traverses each opening (165) and coacts with the grooves (145) to form a plurality of fluid passageways (175).

5 Claims, 7 Drawing Figures

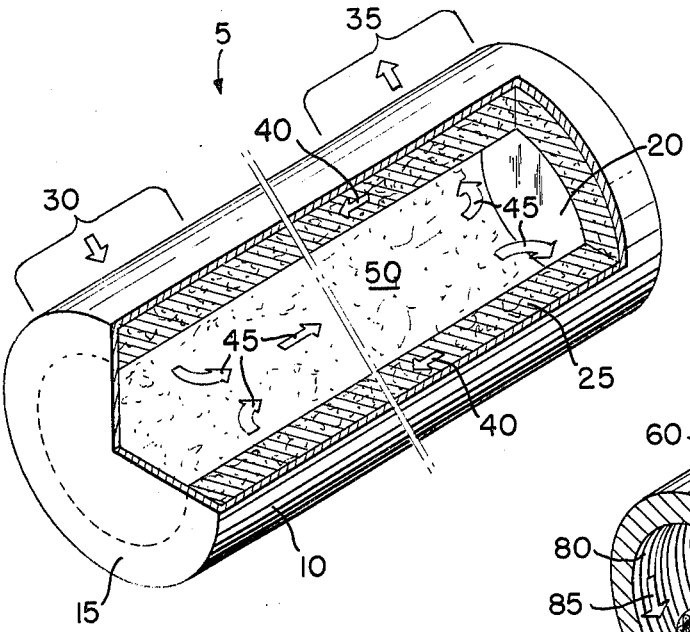
FIG. 1
PRIOR ART
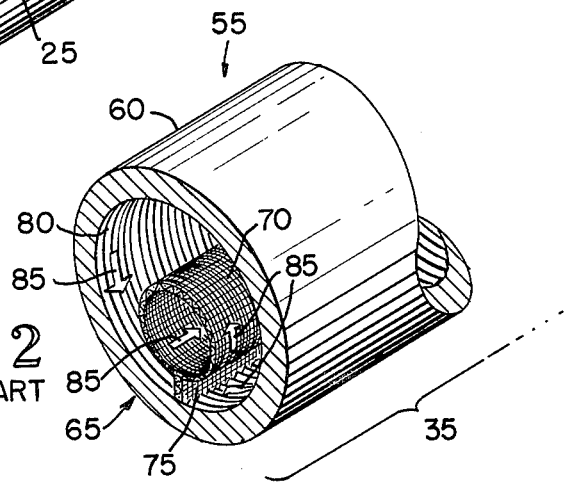
FIG. 2
PRIOR ART
FIG. 6
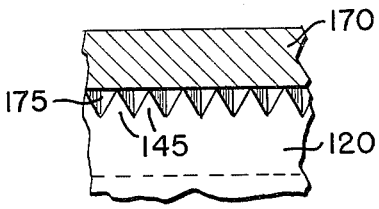
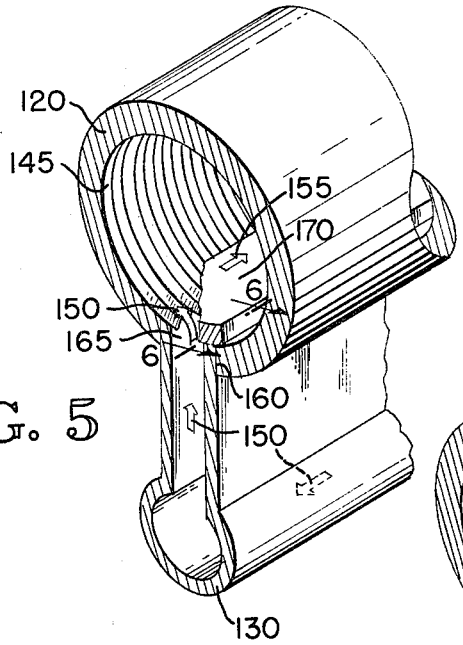
FIG. 5
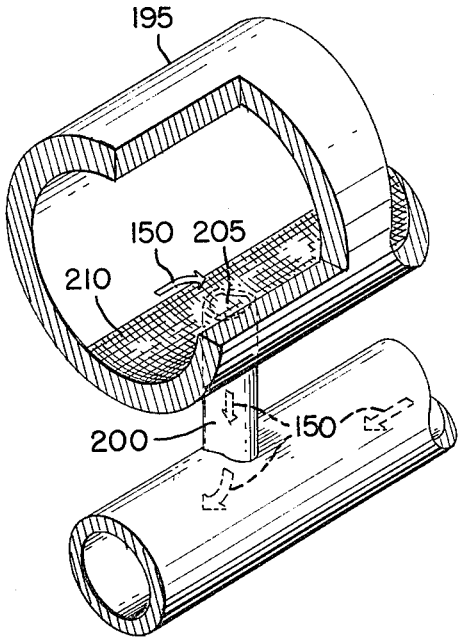
FIG. 7

EXTERNAL ARTERY HEAT PIPE

CROSS-REFERENCE TO RELATED APPLICATIONS

This application is related to U.S. Patent application Ser. No. 334,856, filed Dec. 28, 1981 by Franklin et al. entitled "High Heat Transport Capacity Heat Pipe."

TECHNICAL FIELD

This invention relates generally to thermal transfer systems and more particularly to heat pipes having improved thermal performance.

BACKGROUND OF THE INVENTION

A basic heat pipe comprises a closed or sealed envelope or a chamber containing a liquid-transporting wick and a working fluid capable of having both a liquid phase and a vapor phase within a desired range of operating temperatures. When one portion of the chamber is exposed to a relatively high temperature it functions as an evaporator section. The working fluid is vaporized in the evaporator section causing a slight pressure increase forcing the vapor through an adiabatic flow channel to a relatively lower temperature section of the chamber defined as a condenser section. The vapor is condensed in the condenser section and returned through the liquid-transporting wick to the evaporator section by capillary pumping action.

Because it operates on the principle of phase changes rather than on the principles of conduction or convection, a heat pipe is theoretically capable of transferring heat at a much higher rate than conventional heat transfer systems. Nevertheless, a number of difficulties have been experienced in attempting to use heat pipes for certain applications.

For example, when the wick is made of a capillary material such as a fine-pore wire mesh, the rate of fluid mass flow and consequently heat transfer is limited due to the high pressure drop encountered by the fluid as it flows through the wire mesh. To eliminate this pressure drop, permit increased fluid flow rates and increase heat transfer rates or heat transport capacities, improved heat pipes such as, e.g., pedestal-artery type heat pipes have been fashioned.

In a pedestal-artery type heat pipe, a fluid-conducting wire mesh artery is supported by a wire mesh stem in fluid communication with a wicking medium or fine circumferential grooves disposed on the inner periphery of the heat pipe wall. The fluid-conducting artery is generally designed to promote automatic priming or filling. Once filled, the artery characteristically has a pressure drop equivalent to a round tube and allows relatively high heat transport capacities to be achieved.

In the absence of gravity (e.g., in space), any size artery of this type can theoretically prime. However, most heat pipes suitable for use in space applications must pass a ground (gravity) test before the heat pipe can be used. In the presence of gravity, artery priming is governed by design factors limiting heat pipe transport capacities to only thousands of watt-inches (heat transport rate times distance). However, analysts have estimated that future heat pipe transport capacities in the range of millons of watt-inches may be required thereby necessitating a new approach to artery design.

Recently, a monogroove heat pipe has been developed permitting relatively high heat transport capacities without impacting heat transfer efficiency. It combines the advantages of simple construction and large liquid and vapor areas, with the high heat transfer coefficients of circumferential wall grooves. The basic monogroove design contains two large axial channels, one for vapor and one for liquid. A small slot separates the channels thereby creating a high capillary pressure differential which, coupled with the minimized flow resistance of the two separate channels, results in the high axial heat transport capacity. The high evaporation and condensation film coefficients are provided separately by circumferential wall grooves in the vapor channel without interferring with the overall heat transport capability of the heat pipe.

The thermal performance of the monogroove heat pipe is deleteriously affected by two major factors. For example, continuous liquid flow between the axial liquid channel (artery) and the circumferential wall grooves in the vapor channel must be assured. This continunity must be maintained with groove menisci realistically depressed to reflect maximum heat flux conditions. Unfortunately, this continunity may not be readily maintained in actual use because liquid in the liquid channel has a tendency to boil, due to its proximity to the evaporator section, thereby disrupting flow in the axial slot.

In addition to boiling problems, the monogroove heat pipe is limited by the slot connecting the liquid and vapor channels. To promote high liquid flow rates from the liquid channel to the circumferential grooves, a wide slot should exist. To promote maximum surface tension pumping in the axial slot, the slot should be narrow (i.e., to produce a small meniscus radius). These two competing factors cause the slot width to be set at some intermediate value which neither optimizes meniscus pumping ability nor slot pressure drop.

These two problems do not exist in the present invention. The heat pipe transport system discussed herein utilizes a unique slot cover to maximize axial slot surface tension pumping while permitting a wide axial slot and attendant low slot viscous pressure drops. In addition, steps have been taken to minimize thermal interaction between the liquid channel (artery) and slot, and the heat source.

SUMMARY OF THE INVENTION

Briefly, the present invention provides a heat transfer apparatus of improved heat transport capacity comprising a closed chamber and a working fluid disposed in the chamber. A plurality of grooves are distributed seriatim within the chamber for conducting the fluid. An axial fluid channel extends along the chamber with each of the grooves terminating at the channel. An elongated cap member traversing the channel coacts with the grooves to form a plurality of fluid passageways. A fluid-transporting conduit extends outwardly from the channel and communicates with a fluid conducting tube extending proximate to the chamber.

BRIEF DESCRIPTION OF THE DRAWINGS

FIG. 1 is a perspective view, with parts broken away, of the structure of a basic heat pipe.

FIG. 2 is a partial perspective view of a conventional pedestal-artery type heat pipe.

FIG. 5 is a partial perspective view of the evaporator section of the heat pipe of FIG. 4.

FIG. 6 is a partial sectional view taken along line 6—6 in FIG. 5.

FIG. 7 is a partial perspective view of an optional condensate drain in the adiabatic flow channel of the heat pipe of FIG. 4.

DETAILED DESCRIPTION OF THE INVENTION

Figure 4:
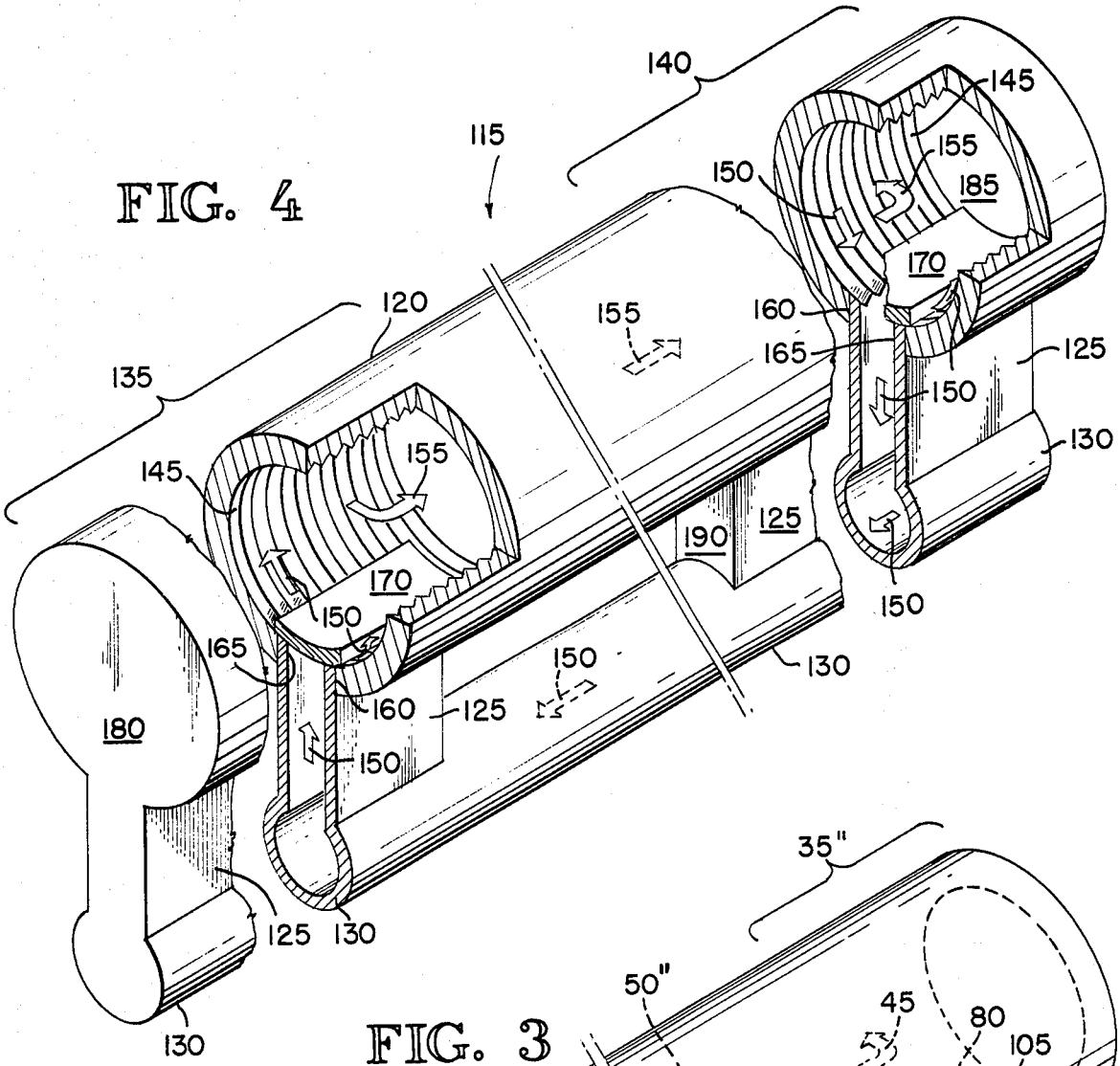
FIG. 4 is a perspective view, with parts broken away, of the improved external artery heat pipe of the present invention.

Referring to the drawings wherein like reference characters refer to the same or similar parts and more particularly to FIG. 1, which shows an embodiment of a typical heat transfer system in a form of a heat pipe 5. The heat pipe 5 comprises a sealed envelope or a tube 10 sealed on both ends 15 and 20. An internal capillary pumping structure such as a wick 25 extends between an evaporator section 30 and a condenser section 35.

In use, the transfer of heat energy occurs when the evaporator section 30, exposed to a relatively high temperature or a heat source (not shown), produces a vaporization of a working fluid 40 capable of having a liquid/vapor phase change. A slight pressure increase results from the vaporization of the fluid 40 within the evaporator section 30 whereby the resultant vapor 45 flows through the interior or adiabatic vapor flow channel 50 of the heat pipe 5 to the relatively cooler, lower pressure condenser section 35 which rejects heat to some external heat sink (not shown). The vapor 45 is condensed in the condenser section 35 back to the liquid state of the fluid 40 and returned through the wick 25 to the evaporator section 30 by capillary pumping action.

The wick 25, illustrated in FIG. 1, may typically comprise a fine mesh screen fitted tightly to the wall of the tube 10. A wick of this type is generally satisfactory but the high pressure drop encountered by the fluid 40 flowing through the screen limits the rate of fluid mass flow resulting in a limitation in the heat transport capacity of the heat pipe 5. To eliminate this pressure drop and permit increased fluid flow rates, improved heat pipes, such as, e.g., a pedestal-artery type heat pipe 55, illustrated in FIG. 2 (only the condenser section 35′ is shown), have been developed.

The heat pipe 55 comprises a sealed envelope or a tube 60 having a pedestal artery assembly 65 fashioned from a fine pore screen mesh. The pedestal artery assembly 65 comprises an artery 70 supported within the tube 60 by means of an artery stem 75. Disposed within the interior periphery of the tube 60 is a thin outer wick, comprising a plurality of circumferential, generally v-shaped, grooves 80. While the artery 70 and the stem 75 extend along the entire length of the tube 60, the grooves 80 are generally disposed only in the evaporator and condenser sections of the heat pipe 55.

During operation of the heat pipe 55, a working fluid 85 flows from a primed artery 70 through the stem 75 to the outer wick 80 disposed in the evaporator section (not shown) of the heat pipe 55. In the evaporator section, the working fluid 85 evaporates from the outer wick 80. In the condenser, the reverse occurs. The fluid 85 (see FIG. 2) condenses on the outer wick 80 and subsequently flows through the stem 75 to the artery 70 where it is transported back to the evaporator section.

Two significant advantages may be accrued from the pedestal-artery heat pipe shown in FIG. 2. First, the artery 70 provides an unobstructed passage for liquid flow thereby resulting in relatively small pressure drops. Secondly, the thin outer wick 80 has little thermal resistance. The outer wick need only be about 0.01 inches thick or less because bulk liquid flow occurs in the artery 70. The primary temperature drops in the heat pipe 55 typically occur through the outer wick 80, and reductions in this resistance substantially reduce source-to-sink temperature gradients.

These advantages of low thermal gradients and relatively small liquid pressure drops can be realized only if the pedestal artery assembly 65 is properly operating. The pedestal artery assembly 65 is designed to fill or prime by itself and once filled has a pressure drop comparable to a round tube.

In the absence of gravity (space), a pedestal artery assembly of any size will theoretically prime but most heat pipes suitable for use in space environments must also pass a ground test before launch into space. In the presence of gravity priming for a pedestal artery is governed by an equation which limits the maximum artery diameter as well as the heat transport times distance capacity of the heat pipe 55. For example, with a fluid such as ammonia and a pedestal stem height of 0.050 inches, the maximum artery diameter is limited to 0.0392 inches. In practice, this translates to a heat transport capacity of 5370 watt-inches (heat transport rate times distance).

Figure 3:
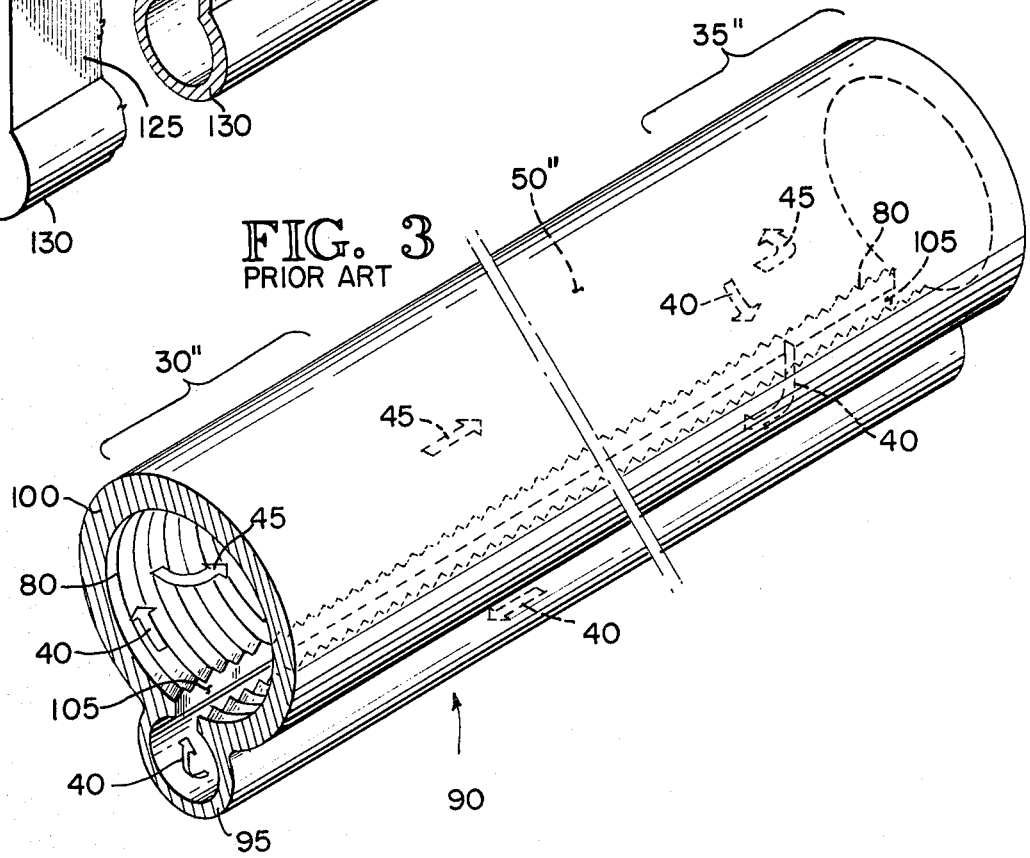
FIG. 3 PRIOR ART
FIG. 3 is a perspective view of a monogroove heat pipe.

An improvement over the pedestal artery-type heat pipe is the monogroove heat pipe concept illustrated in FIG. 3. A monogroove heat pipe, designated as 90 in FIG. 3, comprises a liquid conducting channel 95 and a vapor channel 100 communicating with the liquid channel 95 by means of an axial slot 105. An evaporator section 30″ is defined at one end of the vapor channel 100 and a condenser section 35″ is defined at the other end. A plurality of circumferential capillary grooves are formed in both the evaportor section 30″ and the condenser section 35″.

In use of the monogroove heat pipe 90, the working fluid 40 is vaporized (vapor designated as 45 in FIG. 3) in the circumferential grooves 100 in the evaporator section 35″ and is conducted under pressure through the vapor channel 100 and an adiabatic vapor flow channel section 50″ to the condenser section 35″ where the vapor 45 is condensed within the grooves 80 disposed in the condenser section 35″. Capillary pumping pressure conducts the fluid 40 to the axial slot 105 in the condenser section 35″ which is in fluid communication with the liquid channel 95. The liquid channel 95 conducts condensed working fluid 40 back to the evaporator section 30″ where the process is repeated.

The monogroove heat pipe operating principle is characterized by two differential pressure balance relationships which must be satisfied simultaneously. The primary relationship requires the capillary pumping pressure within the grooves 80 to offset the cumulative viscous pressure losses in the vapor channel 100, the liquid channel 95 and the circumferential wall grooves 80 plus the gravity head losses associated with the inside diameter of the vapor channel 100 and any elevation differences between the evaporator section 30″ and the condenser section 35″ (i.e., adverse tilt under gravity conditions). In addition, the axial slot 105 must possess enough capillary pumping ability to overcome the viscous and gravity head losses due to adverse tilt experienced in the vapor channel 100 and the liquid channel 95.

Unfortunately, the monogroove heat pipe 90 would appear to suffer from certain disadvantages. For example, the liquid channel 95 is disposed closely adjacent to the vapor channel 100 which may result in boiling of the working fluid 40 in the liquid channel 95 proximate to the evaporator section 30''. As a result of nucleate boiling, bubbling can occur in the liquid channel 95 resulting in disruption of the capillary pumping in the axial slot 105. The capillary pumping pressure in the axial slot 105 is inversely proportional to the width of the axial slot. Reducing the width of the axial slot 105 improves pumping pressure, but a narrower slot increases viscous pressure loss in the fluid 40 flowing through the slot 105 as was discussed earlier.

The limitations of a pedestal-artery type heat pipe and the monogroove heat pipe are overcome by the external artery heat pipe of the present invention. The basic principles of the present invention include the provision of a working fluid condensate return path which is free of any wicking material and which can be sized to reduce pressure drops through the pipe to a negligible level.

Referring now to FIG. 4, a perspective view of an external artery heat pipe of the present invention, with parts broken away, is illustrated. The external artery heat pipe, designated by a numeral 115, comprises a vapor channel or a tube 120, a pair of outwardly extending liquid conducting conduits 125 and an axially extending liquid condensate return channel, tube or external artery 130.

Arbitrarily defined within the vapor channel 120 is an evaporator section 135 and a condenser section 140. Formed within the evaporator section 135 and the condenser section 140 are a plurality or a series of separate, axially distributed circumferential v-shaped grooves 145. During use, when the evaporator section 135 is heated by an external heat source (not shown), a working fluid 150 is converted into a vapor 155 which is conducted under pressure to the condenser section 140 where the vapor 155 is condensed back into the liquid phase of the fluid 150 through an exchange of heat with an external heat sink (not shown).

Extending through both the evaporator section 135 and the condenser section 140 is an axial slot 160 providing mating surfaces for the conduits 125. One end of each of the conduits 125 defines an axial fluid conducting channel 165 at which the grooves 145 terminate, as can be best seen in FIG. 5. A pair of arcuate covers or caps 170 cover the axial channel 165 extending in the evaporator section 135 and in the condenser section 140. As depicted in FIG. 6, each cap member 170 coacts with the v-shaped annular grooves 145 to form a plurality of substantially v-shaped fluid pasageways 175. The other end of each of the conduits 125 is joined to and communicates with the external artery 130 (see FIG. 4). Preferrably, an end cap 180 and an end cap 185 closes the open ends of the channel 120, the conduits 125 and the external artery 130. A plate or a panel 190 completes the closure of each of the conduits 125.

In operation, vaporization of the working fluid 150 in the grooves 145 in the evaporator section 135 causes the liquid meniscus in the grooves 145 to recess creating surface tension forces. These surface tension forces pump the liquid 150 around the interior periphery of the evaporator section 135. Axial fluid pumping in the external artery 130 results from fluid (meniscus) recession at the interface between the circumferential grooves 145 and the cover or cap 170, i.e., at the v-shaped passageways 175. The vapor 155 flows through the vapor channel 120, through an adiabatic section 195 defined in the vapor channel 120, to the condensor section 140 where the vapor 155 condenses in and floods the circumferential grooves 145. The condensate or working fluid 150 flows under the slot cover 170 via the fluid passageways 175 in the condensor section 140, down the conduit 125 proximate the condensor section 140 to the external artery 130 where it is returned to the evaporator section 135.

The thermal performance of the present heat pipe 115 can be made independent of the distance separating the evaporator section 135 and the condensor section 140 by scaling the vapor channel 120 and the external artery 130 with the separation distance. The diameter of the vapor channel 120 and the external artery 130 can be increased in proportion to the forth root of the separation distance.

The liquid pressure drops in the present external artery heat pipe are reduced to a negligible level because the width of the axial slot 125 can be increased without reducing the capillary pumping force. Capillary pumping forces in the slot are instead controlled by the small v-shaped passageways 175 resulting from the interfacing of the cover 170 with the grooves 145. Consequently, the heat pipe performance approaches that of the circumferential grooves 145 in the evaporator section 135. The use of an external artery 130 allows bending of the adiabatic section 195 to match installation requirements.

Furthermore, it should be remembered that prior art heat pipes suffer from certain ground test limitations. For example, when ground testing space vehicles in thermal vacuum chambers, alignment of the vehicle can not always be controlled such that the heat pipe is horizontal, i.e., there is adverse tilt. Under these test conditions, the heat pipe must continue to operate although the working fluid must be transferred against gravity in returning to the evaporator section of the heat pipe. The axial slot cover 170, in coacting with the passageways 175, creates a high surface tension pumping ability to help in overcoming this pumping of fluid against gravity.

In use, the adiabatic section 195 in the vapor channel 120 is not truly adiabatic. Consequently, when the evaporator section 135 is separated from the condensor section 140 by relatively large distances condensate 150 may accumulate in the adiabatic section 195. This problem is minimized through the provision of an optional open-ended condensate transfer pipe 200 connecting the interior of the adiabatic section 195 to the external artery 130 (see FIG. 7). The inlet opening 205 of the pipe 200 may be covered by a wire mesh wick structure 210 to transport condensate 150 to the pipe 200 and to prevent depriming of the external artery 130.

The condensate 150 in the external artery 130 is generally in a subcooled condition rendering it possible to readily utilize an ion drag pump (not shown herein but a suitable ion drag pump is generally described in U.S. Pat. No. 4,220,195 issued Sept. 2, 1980 to Borgoyn et al) to pump the working fluid 150 to the evaporator section 135 without forcing excessive liquid flow (i.e., flooding) into it thereby eliminating the need for matching the flow rate of the ion drag pump to the demand of the evaporator section 135. If necessary, further subcooling of the condensate 150 in the external artery 130 can be readily provided by attaching the artery 130 to a heat sink (not shown).

The heat pipe of the present invention is capable of providing heat transport capacities in the range of millions of watt-inches. Furthermore, a high heat transport heat pipe constructed in accordance with the principles of the present invention are readily primed or filled in an accelerational (earth gravity) environment, i.e., using a pump (not shown). They can also be operated at high power levels (i.e., high fluid pumping rates) with the evaporator some distance above the condenser in a gravity environment due to the use of the cover 170 over the axial slot 165. The present heat pipes can sustain high input rates without incurring boiling in the artery due to the high level of thermal isolation of the artery 130 from the evaporation section 135, i.e., the conduit 125 is sufficiently long and sufficiently low in conductance to isolate the artery 130.

Although a preferred embodiment of the invention has been illustrated in the accompanying drawings and described in the foregoing detailed description it will be understood that the invention is not limited to the embodiments disclosed but is capable of numerous rearrangements, modifications and substitutions of the disclosed parts and elements without departing from the spirit of the invention.

What is claimed and desired to be secured by Letters Patent of the United States is:

1. Heat transfer apparatus, comprising:

a closed chamber, a working fluid disposed in said chamber, a plurality of grooves distributed seriatim within said chamber for conducting said fluid, an axial fluid channel extending along said chamber, each of said grooves terminating at said channel, an elongated cap member traversing said channel and coacting with said grooves to form a plurality of fluid passageways, a fluid-transporting conduit extending outwardly from said channel, and a fluid-conducting tube extending proximate said chamber in fluid communication with said conduit.

2. The apparatus of claim 1, further comprising a condenser section and an evaporator section defined within said chamber, said grooves and said channel being disposed within said condenser section and said evaporator section.

3. The apparatus of claims 1 or 2, wherein said chamber is a tube and said grooves are circumferentially disposed within said tube, said grooves being substantially v-shaped.

4. The apparatus of claim 3, further comprising a substantially adiabatic section, said adiabatic section being provided with a condensate drain conduit, said drain conduit communicating with said fluid conducting tube.

5. The apparatus of claim 4, further comprising a screen disposed in said adiabatic section covering the inlet of said drain conduit.

* * * * *